US008628171B2

(12) United States Patent
Terada

(10) Patent No.: US 8,628,171 B2
(45) Date of Patent: Jan. 14, 2014

(54) LIQUID JETTING APPARATUS AND METHOD FOR ADJUSTING INCLINATION OF HEAD HOLDER OF THE LIQUID JETTING APPARATUS

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/602,967

(22) Filed: Sep. 4, 2012

(65) Prior Publication Data

US 2013/0070020 A1 Mar. 21, 2013

(30) Foreign Application Priority Data

Sep. 20, 2011 (JP) ..... 2011-204161

(51) Int. Cl.
*B41J 23/00* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 5,356,360 | A * | 10/1994 | Johns | 482/99 |
| 6,270,184 | B1 * | 8/2001 | Igarashi et al. | 347/37 |
| 2005/0035644 | A1 * | 2/2005 | Lloyd | 297/423.11 |
| 2005/0196214 | A1 | 9/2005 | Ishikawa et al. | |

FOREIGN PATENT DOCUMENTS

JP 2005-246933 A 9/2005

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A liquid jetting apparatus includes a liquid jetting head having a liquid jetting surface in which a plurality of nozzles are aligned along a predetermined direction, a head holder holding the liquid jetting head and being rotatable within a plane parallel to the liquid jetting surface, a rotation regulation member contacting with two contact portions of the head holder to regulate rotation of the head holder, and an inclination adjustment mechanism, which has a cam member being rotatable about a rotation shaft and being capable of displacing a first contact portion of the two contact portions in a direction including a directional component perpendicular to a direction linking the first contact portion with a second contact portion of the two contact portions within the plane, and which adjusts inclination of the head holder by rotating the cam member to rotate the head holder about the second contact portion.

15 Claims, 12 Drawing Sheets

LIQUID JETTING APPARATUS AND METHOD FOR ADJUSTING INCLINATION OF HEAD HOLDER OF THE LIQUID JETTING APPARATUS

CROSS REFERENCE TO RELATED APPLICATION

The present application claims priority from Japanese Patent Application No. 2011-204161, filed on Sep. 20, 2011, the disclosure of which is incorporated herein by reference in its entirety.

BACKGROUND OF THE INVENTION

1. Field of the Invention

The present invention relates to a liquid jetting apparatus which jets liquid and a method for adjusting inclination of a head holder of the liquid jetting apparatus.

2. Description of the Related Art

Conventionally, as liquid jetting apparatuses which jet liquids from a plurality of nozzles, an ink jet printer which performs printing on a recording paper by jetting inks from a plurality of nozzles formed in an ink jet head has been known. In such an ink jet printer, the ink jet head is attached such that a nozzle alignment direction may be oriented in a predetermined direction (to be referred to as a reference direction below) in the printer.

For example, a conventional image recording apparatus carries out printing on a recording paper transported along an X-direction (to be referred to as a transport direction below) perpendicular to a predetermined Y-direction, by jetting ink from an ink jet head placed on a carriage (a head holder) moving reciprocatingly and being guided by a guide member extending in the Y-direction (to be referred to as a scanning direction below). In the conventional image recording apparatus, the ink jet head is attached to the carriage such that the nozzle alignment direction may be parallel to the transport direction which is the reference direction.

However, due to some errors and the like in attaching the ink jet head to the carriage, in some cases, the nozzle alignment direction may be inclined with respect to the transport direction in a plane parallel to the ink jet surface in which the plurality of nozzles are formed. In such manner, when the nozzle alignment direction is inclined with respect to the transport direction, for example, if the ink is jetted with the same jet timing as the nozzle alignment direction is not inclined, then each of the landing positions of the ink jetted from the plurality of nozzles forming a nozzle row may possibly deviate in the scanning direction of the carriage, and the print quality is lowered.

Therefore, in order to prevent lowering the print quality, there are methods for correcting the inclination of the carriage (the ink jet head) so as to eliminate the inclination between the nozzle alignment direction and the transport direction in the plane parallel to the ink jet surface in which the plurality of nozzles are formed.

In the conventional image recording apparatus, the carriage is guided along the scanning direction by first and second slide projections, which are provided on the carriage and slide on a slide surface provided on the guide member along the scanning direction. The first slide projection is fixed on the carriage, whereas the second slide projection is configured to be slidable with respect to the carriage by a posture adjustment means (an inclination adjustment mechanism). It is possible to adjust the inclination of the carriage with respect to the guide member by rotating the second slide projection by the posture adjustment means with the first slide projection as a rotation axis.

The posture adjustment means includes an adjustment block formed integrally with the second slide projection, a circular eccentric shaft which has an outer circumferential surface and which is in contact with a contact surface of the adjustment block by the outer circumferential surface by being fitted into the adjustment block, a circular dial plate formed integrally with the circular eccentric shaft, etc. Then, the dial plate is turned to rotate the circular eccentric shaft. By virtue of this configuration, it is possible to change the position of the outer circumferential surface of the circular eccentric shaft, so as to move the adjustment block in contact with the circular eccentric shaft integrally with the second slide projection.

However, in order to increase the number of dots formable at one time for high-speed printing, it is preferable to elongate the nozzle row. However, the longer the nozzle row is, the more the reduction becomes in print quality due to the inclination of the nozzle alignment direction with respect to the transport direction (the reference direction). If the nozzle row is considerably long, then even though the nozzle row is only a little inclined with respect to the transport direction, the landing positions of the ink jetted respectively from the nozzles on both ends of the nozzle row deviate greatly in the scanning direction, thereby greatly lowering the print quality. Hence, in order to possibly eliminate even a little inclination, it is necessary to make it possible to adjust the inclination of the carriage (the head holder) in a highly minute manner. In order to minutely adjust the inclination of the head holder by the posture adjustment means (the inclination adjustment mechanism) of the conventional image recording appartus, it is necessary to minutely form grooves in the dial plate, or reduce the eccentricity of the circular eccentric shaft (the displacement amount is small with respect to the rotation angle).

However, if the grooves formed in the dial plate are simply made minute, then because the intervals of the grooves become small in the circumferential direction, considering the workability, it is necessary to enlarge the diameter of the dial plate. As a result, the inclination adjustment mechanism becomes large in size. On the other hand, if the eccentricity of the circular eccentric shaft is reduced, then the adjustment block (the second slide projection) has a narrow movable range. Hence, if the inclination is comparatively large, then the adjustment becomes impossible, thereby lowering the yield ratio.

SUMMARY OF THE INVENTION

Accordingly, an object of the present teaching is to provide a liquid jetting apparatus capable of minutely adjusting an inclination of the head holder and securing a wide range of adjusting the inclination, while the inclination adjustment mechanism is miniaturized.

According to an aspect of the present invention, there is provided a liquid jetting apparatus including: a liquid jetting head which has a liquid jetting surface in which a plurality of nozzles are aligned along a predetermined nozzle alignment direction; a head holder which holds the liquid jetting head and which is rotatable within a plane parallel to the liquid jetting surface; a rotation regulation member which contacts with two contact portions of the head holder within the plane to regulate rotation of the head holder within the plane; and an inclination adjustment mechanism of the head holder, which has a cam member being rotatable about a rotation shaft provided in the head holder and being capable of displacing, relative to the liquid jetting head, a first contact portion of the head holder which is one of the two contact portions in a direction including a directional component perpendicular to a direction linking the first contact portion with a second contact portion of the head holder which is the other of the two contact portions within the plane, and which adjusts inclination of the head holder regulated by the rotation regulation member by rotating the cam member to rotate the head holder about the second contact portion such that the nozzle alignment direction becomes parallel to a predetermined reference direction, wherein the inclination adjustment mechanism includes a lever member which is attached to the cam member at a plurality of angular positions in a rotation direction of the cam member and which is rotatable integrally with the cam member in an attached state.

According to the liquid jetting apparatus of the present teaching, by rotating the cam member to displace the first contact portion relatively with the liquid jetting head within a plane, the whole head holder is rotated within the plane with the second contact portion as the rotation center, so as to adjust the inclination of the head holder regulated by the rotation regulation member. At this time, without directly rotating the cam member, a lever member is attached to the cam member to rotate the cam member by swinging the lever member. By virtue of this, because the movement amount is large on the lever apex side with respect to a small rotation angle of the cam member when the lever member is swung, it becomes easy to minutely adjust the inclination of the head holder. Therefore, it is possible to minutely adjust the inclination of the head holder by minutely setting the rotation angle of the cam member (the swing angle of the lever member).

Further, by switching the angular position, in the rotation direction of the cam member, at which the second engagement portion of the lever member engages with the first engagement portion of the cam member, it is possible to attach the lever member to the cam member at a plurality of different angular positions, thereby making it possible to change the range of adjusting the inclination of the head holder. Therefore, without widening the range of swinging the lever member, it is possible to secure a wide range of adjusting the inclination of the head holder while the inclination adjustment mechanism is miniaturized.

DESCRIPTION OF THE PREFERRED EMBODIMENT

Hereinbelow, an embodiment of the present teaching will be explained. This embodiment is an example of applying the present teaching to an ink jet printer which records characters, images and the like by jetting ink onto a recording paper.

Figure 1:
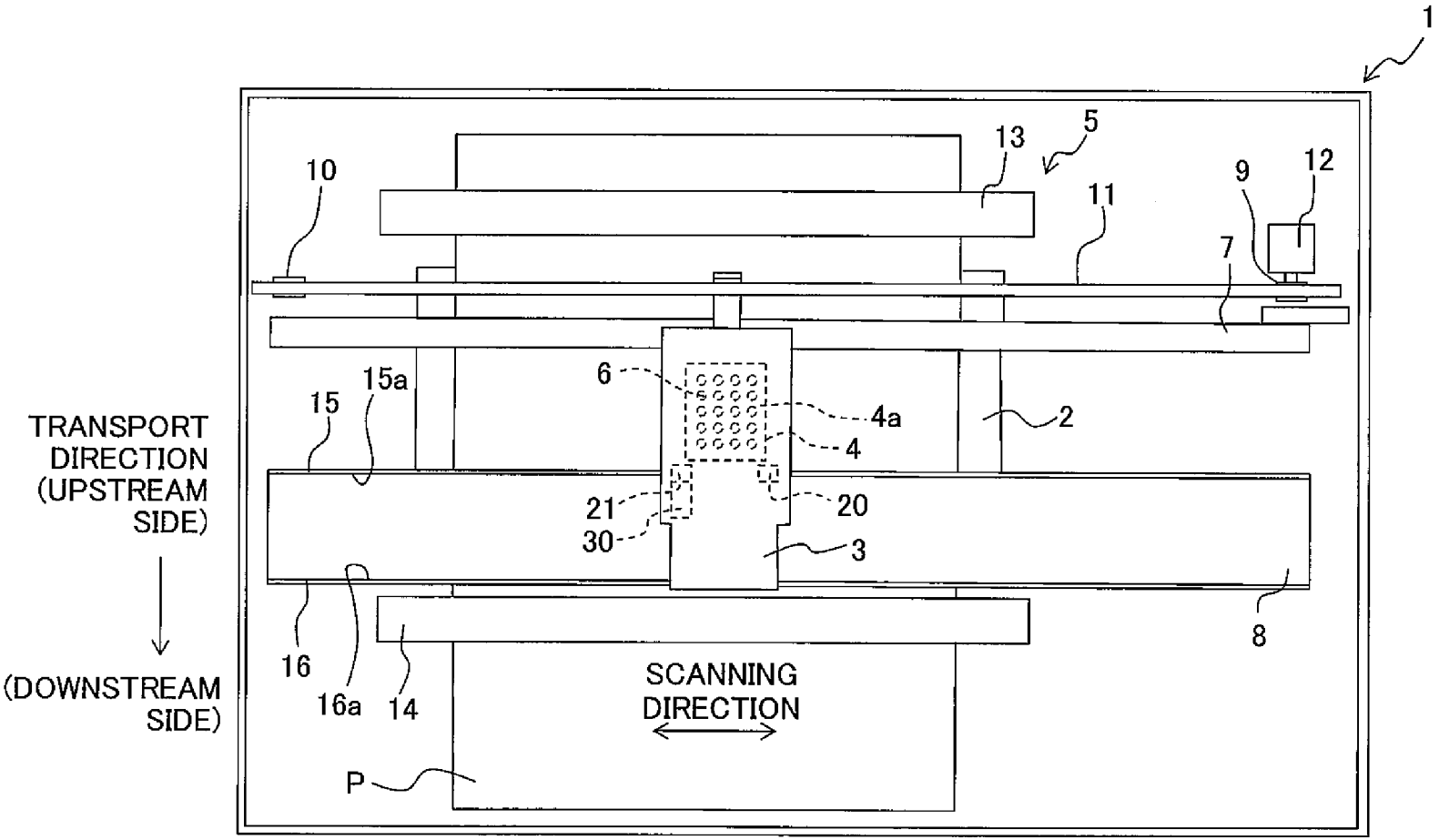
FIG. 1 is a plan view showing a schematic configuration of an ink jet printer as an example of the liquid jetting apparatus in accordance with an embodiment of the present teaching.

First, explanations will be made with respect to a schematic configuration of an ink jet printer 1 in accordance with the embodiment. As shown in FIG. 1, the ink jet printer 1 (a liquid jetting apparatus) has a platen 2 on which a recording paper P is placed, a carriage 3 (a head holder) capable of reciprocating in a scanning direction parallel to the platen 2 (a left-right direction of FIG. 1: a first direction), an ink jet head 4 (a liquid jetting head) installed on the carriage 3, a transport mechanism 5 transporting the recording paper P in a transport direction (an up-down direction of FIG. 1) perpendicular to the scanning direction, and the like.

On the upper surface of the platen 2, there is placed the recording paper P supplied from an unshown paper feed mechanism. Above the platen 2, two guide rails 7 and 8 are provided to extend in parallel along the scanning direction. The carriage 3 is configured to be capable of reciprocating in an area facing the platen 2 along the two guide rails 7 and 8 in the scanning direction.

The carriage 3 is connected with an endless belt 11 reeled on two pulleys 9 and 10. When a carriage drive motor 12 drives the endless belt 11 to move, the carriage 3 moves in the scanning direction along with the movement of the endless belt 11. As will be explained in detail later, the carriage 3 is parallel to the upper surface of the platen 2. Within a horizontal plane parallel to the transport direction and the scanning direction (the plane parallel to the paper plane of FIG. 1), an inclination angle of the carriage 3 with respect to the guide rail 8 (a rotation regulation member) can be changed by an aftermentioned inclination adjustment mechanism 30.

The ink jet head 4 is installed on a lower side of the carriage 3. The lower surface of the ink jet head 4 is parallel to the upper surface of the platen 2 at intervals in the up-down direction, and forms an ink jet surface 4*a* on which a plurality of nozzles 6 open. The plurality of nozzles 6 are aligned in the transport direction to form nozzle rows. These nozzle rows are arranged in four rows in the scanning direction. The plurality of nozzles 6 formed in the ink jet surface 4*a* are driven by an unshown piezoelectric actuator to jet inks of black, yellow, cyan and magenta onto the recording paper P placed on the platen 2, respectively, in order of the nozzle rows from the left side of FIG. 1.

The transport mechanism 5 has two transport rollers 13 and 14 arranged to sandwich the platen 2 from the transport direction. The transport mechanism 5 transports the recording paper P placed on the platen 2 in the transport direction (downward in FIG. 1) by these two transport rollers 13 and 14.

Then, the ink jet printer 1 jets the inks from the ink jet head 4 moving reciprocatingly along with the carriage 3 in the scanning direction onto the recording paper P placed on the platen 2, while recording desired characters, images and the like on the recording paper P by the two transport rollers 13 and 14 which transport the recording paper P in the transport direction (downward in FIG. 1).

Figure 2:
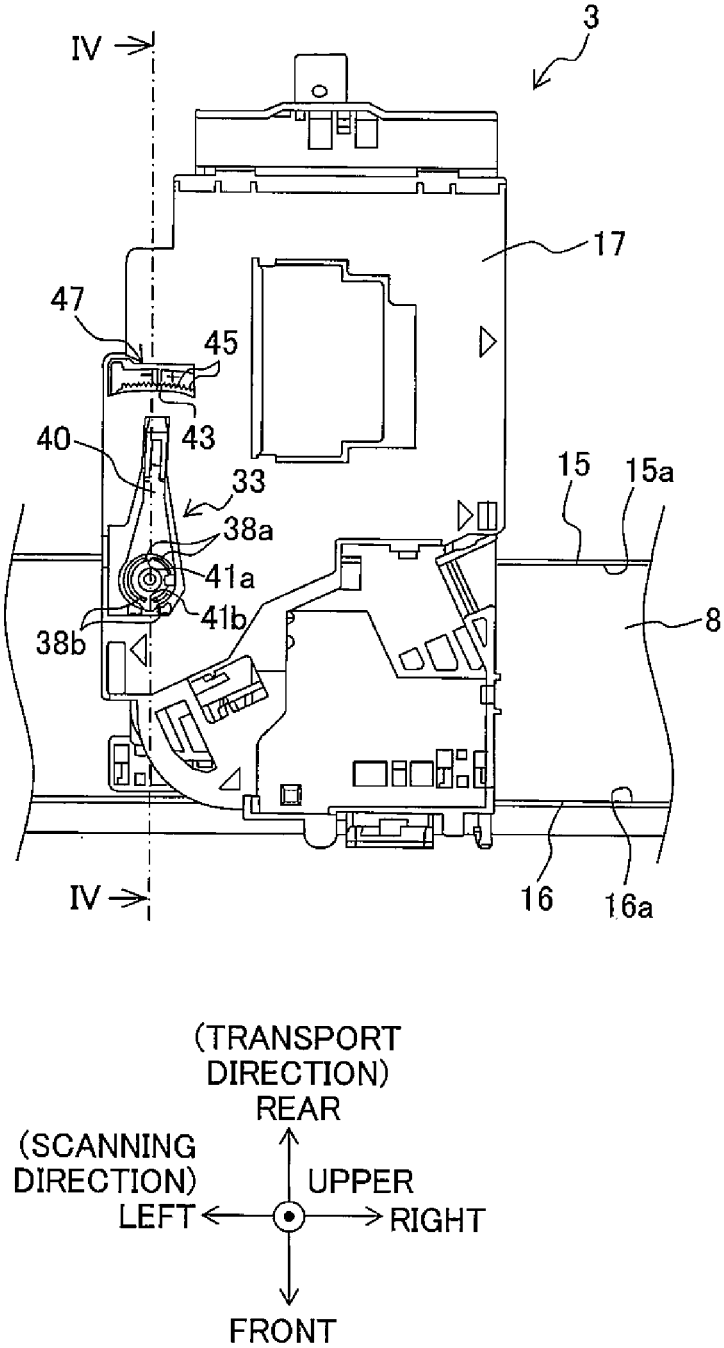
FIG. 2 is a top view of a carriage of the ink jet printer of FIG. 1.
Figure 3:
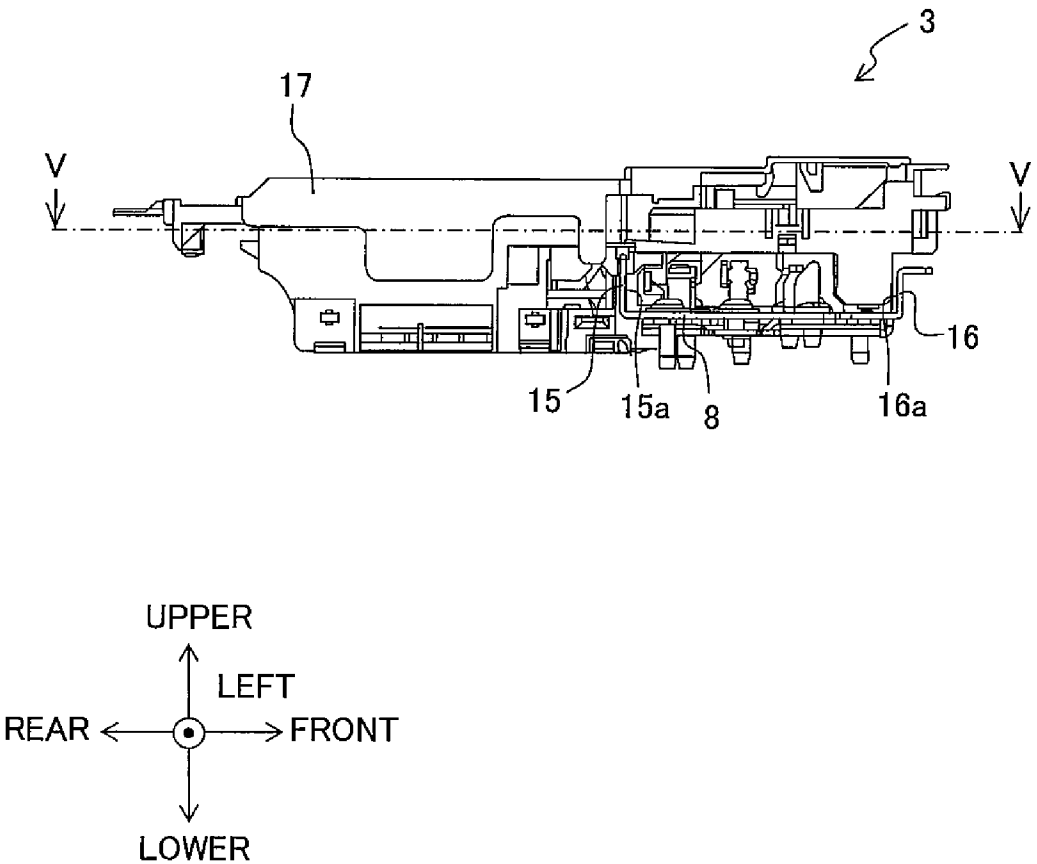
FIG. 3 is a side view of the carriage of the ink jet printer of FIG. 1.

Next, a detailed explanation will be made for a configuration of the guide rails 7 and 8 guiding the carriage 3. Further, FIGS. 2 and 3 show the guide rail 8, too, in addition to the carriage 3. Further, the following explanation will be made, as necessary, with the downstream side in the transport direction as the front side, the upstream side in the transport direction as the rear side, the left and right directions along the scanning direction in FIG. 1 as the left and right directions, the near side directed out of the paper plane in FIG. 1 as the upper side, and the far side directed into the paper plane in FIG. 1 as the lower side.

As shown in FIG. 1, the guide rail 7 is an approximately rectangular plate member elongated in the scanning direction. The area of almost half the upper surface of the guide rail 7 on the front side is arranged to face the lower surface of the carriage 3. An unshown slide member provided on the lower side of the carriage 3 is configured to contact with the upper surface of the guide rail 7 due to its own weight to be slidable along the scanning direction.

Further, as shown in FIGS. 1 and 2, the guide rail 8 is, in common with the guide rail 7, an approximately rectangular plate member elongated in the scanning direction. Then, on the guide rail 8, guide walls 15 and 16 are formed to stand upward and arranged apart from each other in the transport direction. The surfaces of the guide walls 15 and 16 facing each other, that is, the surface of the guide wall 15 on the front side and the surface of the guide wall 16 on the rear side, are guide surfaces 15*a* and 16*a* extending respectively in the scanning direction.

Next, the carriage 3 will be explained. As shown in FIG. 1, the ink jet head 4 is installed on the carriage 3 as described above and, meanwhile, the carriage 3 is provided with a fixed slide member 20, a movable slide member 21, the inclination adjustment mechanism 30, and the like. A cover 17 covers up the opening of the carriage 3 on the upper side (see FIG. 2).

The fixed slide member 20 is provided on a right end portion at almost the center in the front-rear direction, fixed on the carriage 3, and sandwiches the guide wall 15 of the guide rail 8 from the front and rear directions. Its surface facing the guide surface 15*a* is a slide surface 20*a* (see FIGS. 7A to 7C) in slidable contact with the guide surface 15*a*.

The movable slide member 21 is provided apart from the fixed slide member 20 in the left-right direction on a left end portion at almost the center in the front-rear direction and, in common with the fixed slide member 20, sandwiches the guide wall 15 of the guide rail 8 from the front and rear directions. Its surface facing the guide surface 15*a* is a slide surface 21*a* (see FIGS. 7A to 7C) in slidable contact with the guide surface 15*a*. Further, differing from the fixed slide member 20, the movable slide member 21 is not fixed on the carriage 3 but is configured to be movable in the front-rear direction with respect to the carriage 3.

The carriage 3 has a biasing means 18 including an elastic member such as a spring and the like. (see FIGS. 7A to 7C), and the biasing means 18 biases a guide surface 16*a* of the guide wall 16. Therefore, the carriage 3 is biased toward the guide surface 15*a* side (the rear side) by the press-back force from the guide surface 16*a*. By virtue of this, the slide surface 20*a* of the fixed slide member 20 and the slide surface 21*a* of the movable slide member 21 are slidably pressed on the guide surface 15*a*, and thereby the carriage 3 is guided along the guide walls 15 and 16 in the scanning direction.

Next, the inclination adjustment mechanism 30 will be explained.

Figure 4:
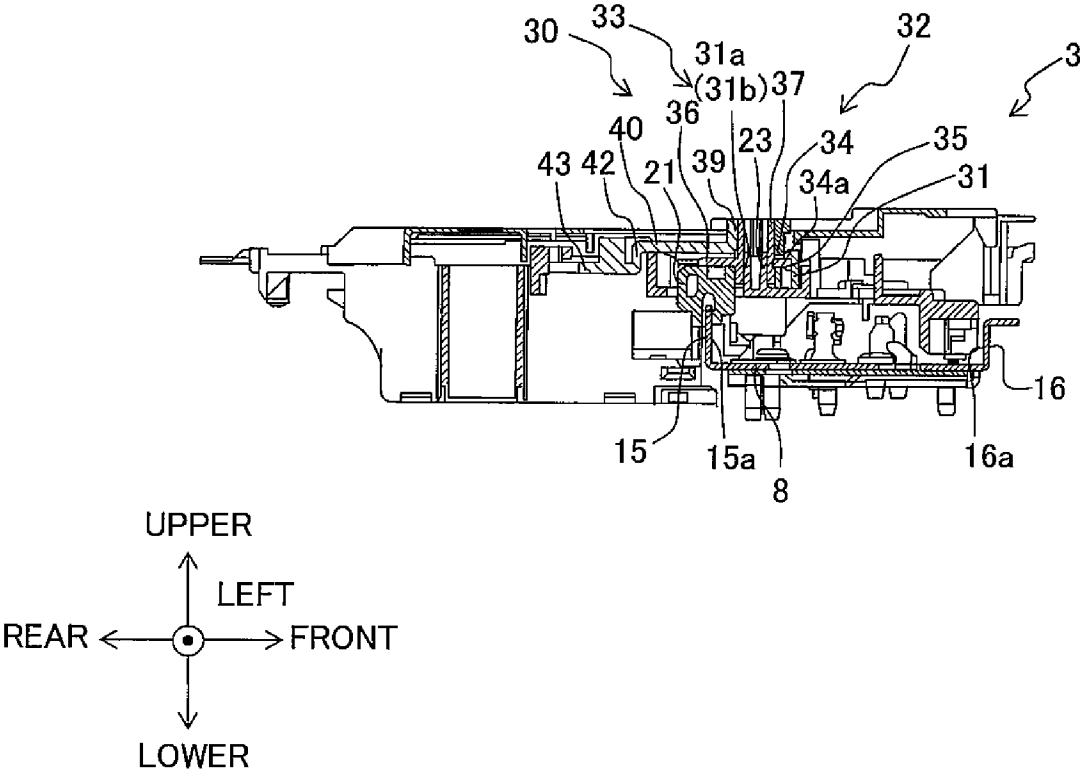
FIG. 4 is a cross-sectional view taken along the line IV-IV of FIG. 2.
Figure 5:
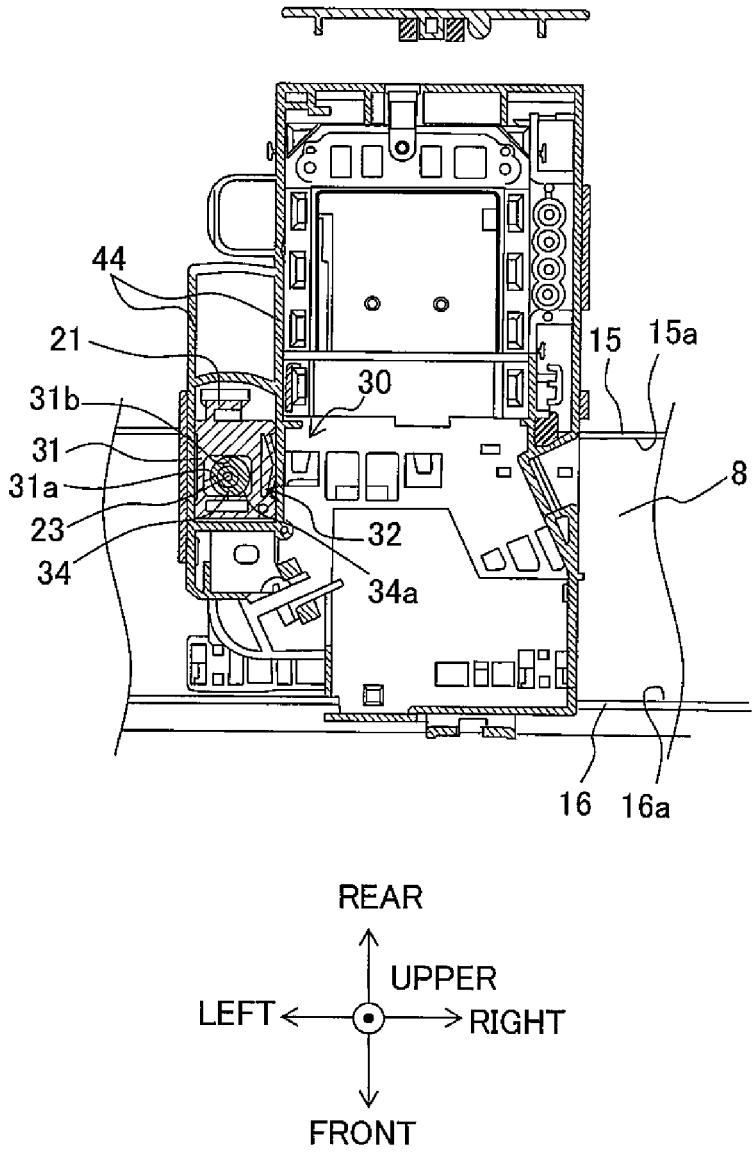
FIG. 5 is a cross-sectional view taken along the line V-V of FIG. 3.
Figure 6:
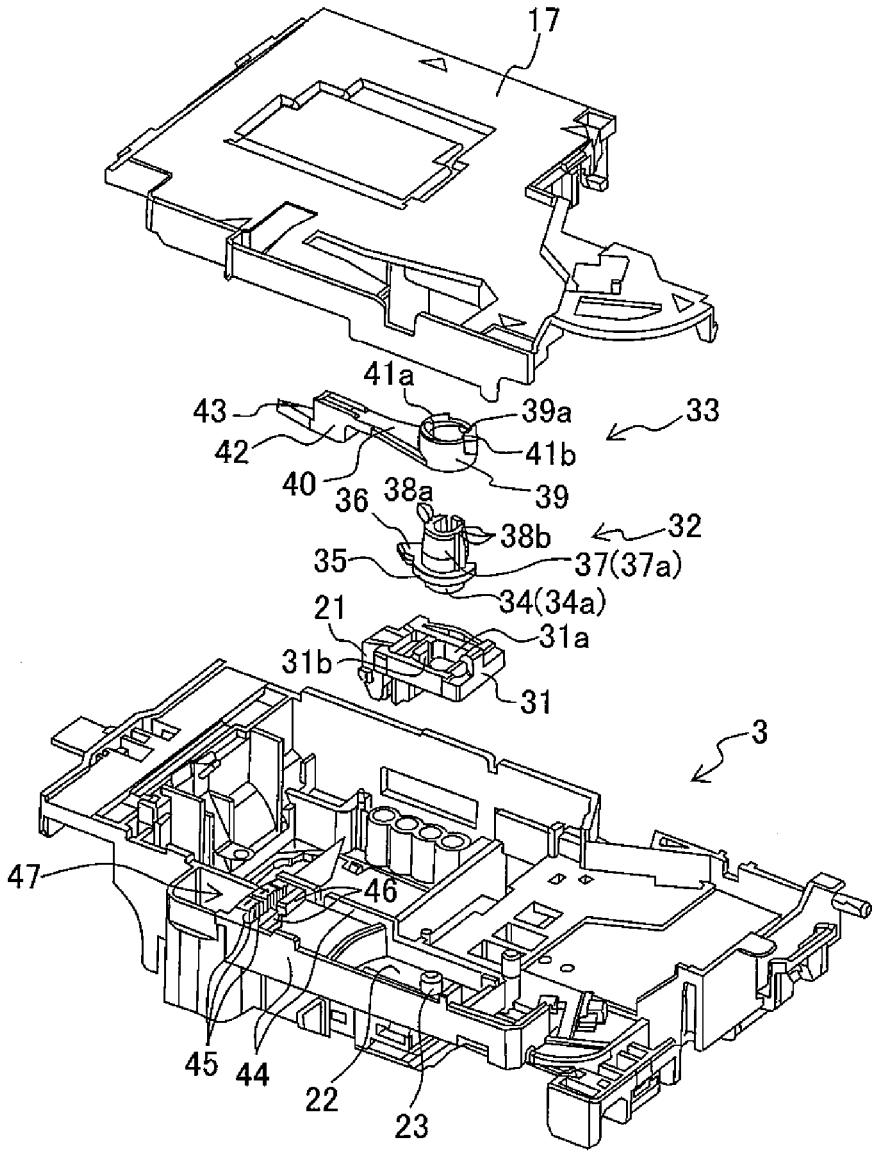
FIG. 6 is an exploded perspective view of an inclination adjustment mechanism inside the carriage.
Figure 6:
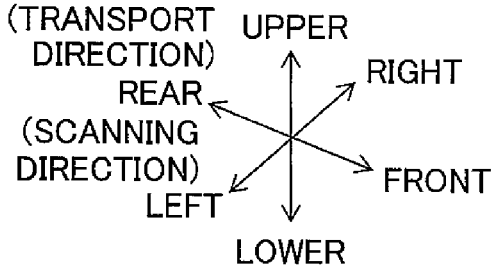

The inclination adjustment mechanism 30 is a mechanism for changing the angle of the carriage 3 with respect to the guide rail 8 within the horizontal plane. As shown in FIGS. 4 to 6, this inclination adjustment mechanism 30 has a slide member 31, a cam member 32, a lever member 33, and the like.

The slide member 31 is formed integrally with the movable slide member 21, and contained in a recess 22 (see FIG. 6) provided in a left end portion of the carriage 3 at almost the center in the front-rear direction. The slide member 31 is configured to be slidable in parallel with the front-rear direction along with the movable slide member 21 with respect to the carriage 3. Further, a through hole 31*a* is formed in the approximately central portion of the slide member 31 to dispose therein an aftermentioned eccentric cam 34 of the cam member 32.

The cam member 32 has the eccentric cam 34 contained in the through hole 31*a* of the slide member 31 and rotating about an axial center within the horizontal plane, a direction indication portion 35 connected with the upper surface of the eccentric cam 34 and having a projection 36 projecting from the lateral side in a radial direction, and an attachment shaft portion 37 connected with the upper surface of the direction indication portion 35 and installed with the lever member 33.

The eccentric cam 34 is provided in the carriage 3, and a rotation shaft portion 23 extending in the up-down direction is inserted through the eccentric cam 34 which is then rotatable about the rotation shaft portion 23. With respect to the front-rear direction, the length of the through hole 31*a* formed in the slide member 31 is sufficiently the same as the diameter of the eccentric cam 34. As a cam surface 34*a* of the eccentric cam 34 contacts with a contact surface 31*b* which is a wall surface defining both ends of the through hole 31*a* in the front-rear direction, the eccentric cam 34 is pressed into the through hole 31*a*. By virtue of this, as the eccentric cam 34 rotates, a displacement in the front-rear direction occurs in the positional relation between the rotation shaft portion 23 inserted through the eccentric cam 34, and the contact surface 31*b* in contact with the cam surface 34*a*. Then, the carriage 3 provided with the rotation shaft portion 23 moves relatively with the slide member 31 provided with the contact surface 31*b* in the front-rear direction.

Here, the inclination of the carriage 3 will be explained when the eccentric cam 34 of the cam member 32 is rotated.

Figure 7A:
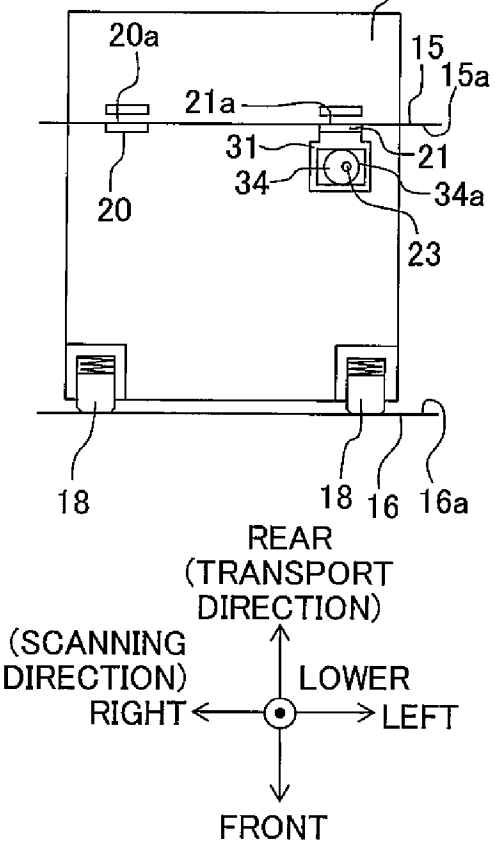
FIGS. 7A to 7C are pattern diagrams for explaining an inclination of the carriage when rotating an eccentric cam of a cam member.

First, as shown in FIG. 7A, in the initial position, the widest portion from the rotation shaft of the eccentric cam 34 to the cam surface 34*a* is positioned on the left side within the slide member 31. That is, the rotation shaft portion 23 provided in the carriage 3 is positioned on the right side within the slide member 31.

Figure 7B:
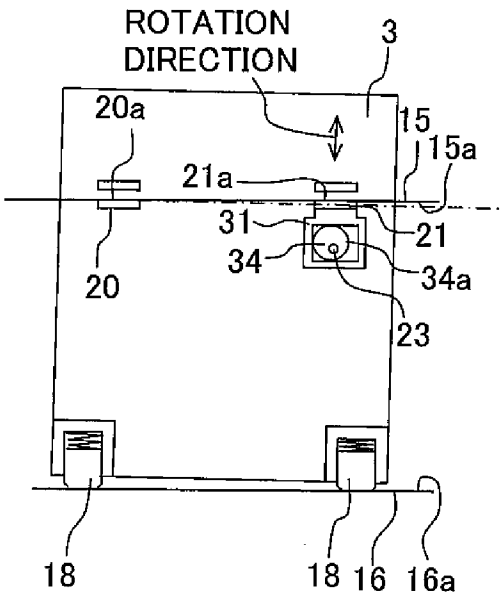

In this state, as shown in FIG. 7B, if the eccentric cam 34 is rotated 90 degrees in clockwise direction, then the widest portion of the eccentric cam 34 moves rearward. By virtue of this, the thickness of the eccentric cam 34 inserted between the slide member 31 and the rotation shaft portion 23 increases, and thus the rotation shaft portion 23 provided in the carriage 3 moves frontward.

Therefore, because the rotation shaft portion 23 moves frontward, the carriage 3 is rotated in clockwise direction centered on the contact portion of the guide wall 15 of the guide rail 8 with the fixed slide member 20. Further, as shown in FIG. 7B, the frontward movement amount of the rotation shaft portion 23 of the carriage 3 becomes the maximum when the widest portion of the eccentric cam 34 has come to the rear end.

Figure 7C:
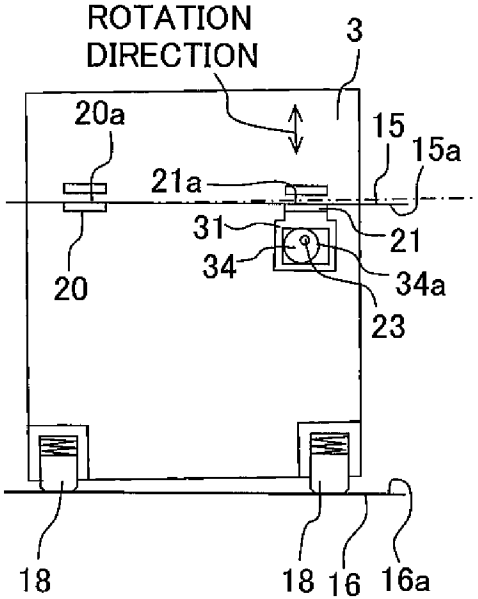

Further, from the initial position shown in FIG. 7A, if the eccentric cam 34 is rotated 90 degrees in counterclockwise direction as shown in FIG. 7C, then the widest portion of the eccentric cam 34 moves frontward. By virtue of this, the thickness of the eccentric cam 34 inserted between the slide member 31 and the rotation shaft portion 23 decreases, and thus the rotation shaft portion 23 provided in the carriage 3 moves rearward.

Therefore, because the rotation shaft portion 23 moves rearward, the carriage 3 is rotated in counterclockwise direction centered on the contact portion of the guide wall 15 of the guide rail 8 with the fixed slide member 20. Further, as shown in FIG. 7C, the rearward movement amount of the rotation shaft portion 23 of the carriage 3 becomes the maximum when the widest portion of the eccentric cam 34 has come to the front end.

Further, the contact portion of the guide surface 15*a* of the guide wall 15 of the guide rail 8 with the slide surface 21*a* of the movable slide member 21 in this embodiment, corresponds to a first contact portion in accordance with the present invention. Further, the contact portion of the guide surface 15*a* of the guide wall 15 of the guide rail 8 with the slide surface 20*a* of the fixed slide member 20 in this embodiment, corresponds to a second contact portion in accordance with the present invention. Then, the guide rail 8 guides the carriage 3 in the scanning direction, and regulates the rotation of the carriage 3.

As shown in FIGS. 4 to 6, the attachment shaft portion 37 of the cam member 32 is shaped into a truncated cone tapering upward. In the attachment shaft portion 37, there are formed three rear grooves 38*a* arranged at equal intervals in a semicircular area of its outer circumferential surface on the rear side in the circumferential direction, and three front grooves 38*b* arranged point-symmetrically with the three rear grooves 38*a* with the center of the truncated cone as the axis in a semicircular area on the front side. Among the three rear grooves 38*a*, the middle rear groove 38*a* is arranged at the same position as the projection 36 of the direction indication portion 35 in the circumferential direction of the attachment shaft portion 37. Then, the projection 36 of the direction indication portion 35 faces the rear side, and the position of the cam member 32, where the middle rear groove 38*a* is aligned with the middle front groove 38*b* in the front-rear direction, is the aforementioned initial position at which the rotation shaft portion 23 is located at the right end of FIG. 7A within the slide member 31. Further, for convenience here the initial position is taken to be the position at which the projection 36, the rear groove 38*a* and the front groove 38*b* are aligned in the front-rear direction. In reality, however, the initial position may as well be taken to be the position at which the projection 36, the rear groove 38*a* and the front groove 38*b* are inclined to the front-rear direction as shown in FIG. 2.

The lever member 33 has a swing shaft portion 39 with a through hole 39*a* formed to insert the attachment shaft portion 37 therethrough, and a rod-like lever portion 40 extending from the circumferential surface of the swing shaft portion 39 in a radial direction. The lever portion 40 has a multilevel portion 42 flexed in the middle part, and a tapered apex portion 43. On the surface of an inner circumference defining the through hole 39*a* of the swing shaft portion 39, a pair of projections 41*a* and 41*b* are formed to be engageable with one rear groove 38*a* of the attachment shaft portion 37, and one front groove 38*b* arranged to be point-symmetrical with that one rear groove 38*a*.

By the pair of projections 41*a* and 41*b* in selective engagement with a point-symmetrical pair of any of the three rear grooves 38*a* and front grooves 38*b*, the lever member 33 is positioned with respect to the cam member 32 in a plurality of different angular arrangements (angular positions), and engaged with the cam member 32 by a contact pressure with a taper surface 37*a* of the attachment shaft portion 37. That is, by the contact pressure in a radial direction of the attachment shaft portion 37 between the inner circumferential surface of the through hole 39*a* of the swing shaft portion 39 and the taper surface 37*a* of the attachment shaft portion 37, a friction force is generated in the circumferential direction of the inner circumferential surface of the through hole 39*a* between the inner circumferential surface of the through hole 39*a* and the taper surface 37*a* of the attachment shaft portion 37. When adjusting the angle of the carriage 3 as will be described later, by swinging the lever member 33 installed on the cam member 32, the eccentric cam 34 is rotated to turn the carriage 3 with respect to the guide rail 8.

In this manner, the contact pressure engages the attachment shaft portion 37 of the cam member 32 with the swing shaft portion 39 of the lever member 33 such that the force in swinging the lever member 33 is transmitted through the taper surface 37*a* of the attachment shaft portion 37. This reduces the force exerted between the rear groove 38*a* and front groove 38*b* of the cam member 32, and the projections 41*a* and 41*b* of the lever member 33 when the lever member 33 is swung. Therefore, neither abrasion nor deformation may easily occur in the rear groove 38*a*, the front groove 38*b*, and the projections 41*a* and 41*b*. Further, even though there is more or less clearance between the rear groove 38*a* and front groove 38*b*, and the projections 41*a* and 41*b* of the lever member 33, no looseness may arise in the attachment shaft portion 37 and the swing shaft portion 39 in the rotation direction. Therefore, it is possible to stably maintain the inclination of the ink jet head 4. Further, the plurality of rear grooves 38*a* and the plurality of front grooves 38*b* formed in the attachment shaft portion 37 of the cam member 32 in this embodiment, correspond to a first engagement portion in accordance with the present invention. Further, the projections 41*a* and 41*b* provided on the through hole 39*a* of the lever member 33 in this embodiment correspond to a second engagement portion in accordance with the present teaching.

Further, the carriage 3 is provided with a wall extending rearward and forming the recess 22. Further, it is provided with a pair of regulation walls 44 (regulation members) arranged to stand upward at a little larger interval than the width of the slide member 31 (the eccentric cam 34) in the left-right direction. Between the pair of regulation walls 44, there are provided a plurality of lock grooves 45 (fixation members) which are arranged at equal intervals in the direction of swinging the lever member 33 and are engageable with the apex portion 43 of the lever portion 40 installed on the cam member 32, and a pair of protrusion members 46 which protrude from the opposite surfaces of the pair of regulation walls 44 and form an interspace between their apical ends to make the lever portion 40 passable therethrough.

The lever member 33 can swing between the two regulation walls 44 as installed on the attachment shaft portion 37 such that the lever portion 40 may be disposed between the pair of regulation walls 44. However, if disposed between the pair of regulation walls 44, the lever member 33 cannot swing to the outside of the two regulation walls 44 beyond the two regulation walls 44. Between the pair of regulation walls 44, the range in which the lever member 33 can swing is narrower than 180 degrees, and becomes such a range as fits within the maximum existence range of the inclination adjustment mechanism 30 except the lever member 33, that is, within the width of the cam member 32 or the slide member 31 in the left-right direction. Here, the eccentric cam 34 needs a sufficiently large size to minutely set the rotation angle, and it is possible to design the width of the recess 22 containing the slide member 31 in the left-right direction for the size of the eccentric cam 34. Then, by containing the lever member 33 between the pair of regulation walls 44 with the same width as that of the recess 22 in the left-right direction, the lever member 33 may never swing to the outer side than the recess 22 in the left-right direction. Therefore, the lever member 33 does not come over to the outside and be fixed in positioning in the left-right direction of the carriage 3, and thereby it is possible to miniaturize the carriage.

Then, by the apex portion 43 of the lever portion 40 in engagement with any of the plurality of lock grooves 45, the swing of the lever member 33 is locked. By swinging the lever portion 40 with a force above a certain degree of strength, the apex portion 43 of the lever portion 40 is released from the locked state with the lock groove 45. The plurality of lock grooves 45 are formed to be seven for each of the left and right directions with a reference position as the center. That is, it is possible to swing and lock the lever member 33 at the reference position, and at positions of as many as seven grades in each of the left and right directions.

Behind the plurality of lock grooves 45 formed in the carriage 3, a display portion 47 is provided with the right side as plus side and the left side as the minus side centered on the reference position. By virtue of this display portion 47, it is possible to easily detect how many grades the lever member 33 swings to the plus side or to the left side (the swing angle of the lever member 33). Further, without the display portion 47, it is still possible to detect the swing angle of the lever member 33 by confirming whether or not the apex portion 43 of the lever portion 40 is locked with any of the plurality of lock grooves 45. In this manner, the display portion 47 or the plurality of lock grooves 45 plays or play the role of an indicator for detecting the swing angle of the lever member 33.

Figure 8:
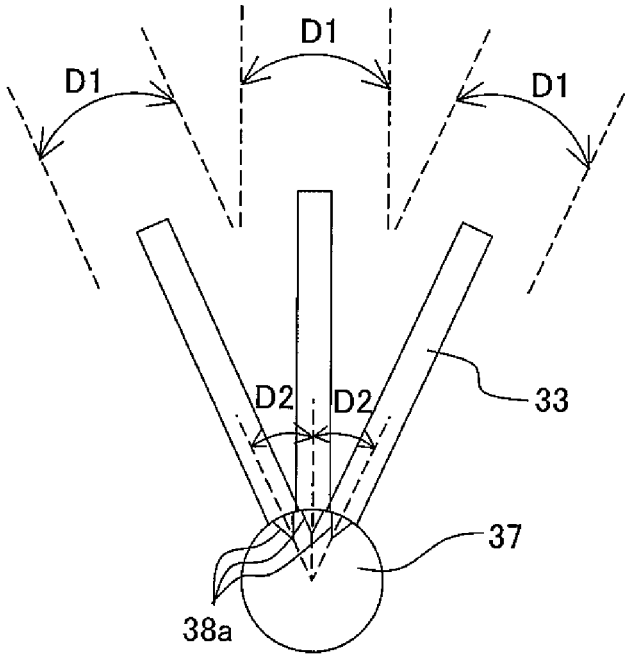
FIG. 8 is a diagram for explaining a swing angle of a lever member and an angle between grooves of an attachment shaft portion.

As shown in FIG. 8, an angular range D1 in which the lever member 33 is swingable between the pair of regulation walls 44 (that is, an angular range between the leftmost lock groove 45 and the rightmost lock groove 45 with the swing shaft portion 39 or the rotation shaft portion 23 as the center), is wider than an angle D2 between two rear grooves 38*a* adjacent to each other in the circumferential direction of the attachment shaft portion 37 with the rotation shaft portion 23 as the center. Further, in the embodiment, as one example, the angular range D1 is ±10.5° (21° of range) with the reference position as the center; the angle D2 is 19.5°; and the rotation angle possible for the eccentric cam 34 to take is ±30° (60° of range) with the reference position as the center. Then, if by assumption the lever member 33 and the cam member 32 are integrated in one body, then because the lever member 33 has to swing ±30° with the reference position as the center, the swing range of the lever member 33 in the left-right direction needs to be 2×length L of lever portion 40×sin 30°. In the embodiment, however, it can be kept within the range of 2×length L of lever portion 40×sin 10.5°.

Further, in the embodiment, the lock grooves 45 are provided at totally 15 places of ±7 grades each by 1.5° with the rotation shaft portion 23 as the center. Therefore, it is possible to attach the lever member 33 in the range of ±1.5°×7=±10.5° each by 1.5°. On the other hand, since an angle of 19.5° is formed between the two adjacent rear grooves 38*a* of the cam member 32 (the attachment shaft portion 37), this is equivalent to the angle of 13 grades of the lock grooves 45 (19.5÷1.5=13). That is, when installing the lever member 33 onto the cam member 32, dismissing one rear groove 38*a* realizes a movement of a slide member equivalent to turning the lever member 33 by 13 grades.

For example, in order to rotate the cam member 32 by 9° in clockwise direction, after engaging the lever member 33 with the middle rear groove 38*a* of the cam member 32, the lever member 33 may be turned 6 grades in clockwise direction (1.5°×6=9°). Alternatively, after engaging the lever member 33 with the rear groove 38*a* adjacent in counterclockwise direction to the middle rear groove 38*a* of the cam member 32, the lever member 33 may be turned 7 grades in counterclockwise direction (19.5°−1.5°×7=9°). In this manner, with respect to a part of angular range, there are two adjustment methods.

Therefore, in the area where the rotation range of the carriage 3 in swinging the lever member 33 to the maximum extent with the projection 41*a* of the lever member 33 engaged with one rear groove 38*a* of the cam member 32 (to be referred to as a first range below), overlaps the rotation range of the carriage 3 in swinging the lever member 33 to the maximum extent with the projection 41*a* of the lever member 33 engaged with the rear groove 38*a* adjacent in the circumferential direction to the above rear groove 38*a* of the cam member 32 (to be referred to as a second range below), there are two adjustment methods.

If, by assumption, an angle of 24° is formed between the adjacent rear grooves 38*a* of the cam member 32, then it is not possible to adjust the cam member 32 into a state of being rotated 12° in clockwise direction even if the lever member 33 is turned seven grades in clockwise direction (1.5°×7=10.5°) after engaging the lever member 33 with the middle rear groove 38*a* of the cam member 32, or even if the lever member 33 is turned seven grades in counterclockwise direction (24°−1.5°×7=13.5°) after engaging the lever member 33 with the rear groove 38*a* adjacent in counterclockwise direction to the middle rear groove 38*a* of the cam member 32.

In this manner, it is possible to restrain an unadjustable range from arising between the first range and the second range for the carriage 3 to rotate, due to individual difference of the ink jet printer 1. Further, it is possible to take the first range and the second range to be a continuous range, whereby it is possible to secure a continuous wide range (angle) for the carriage 3 to rotate.

Further, in the center along the left-right direction between the pair of regulation walls 44, the pair of protrusion members 46 form an interspace through which the lever portion 40 is passable. Then, with the apex portion 43 of the lever portion 40 facing the rear side, the lever member 33 passes through the interspace of the pair of protrusion members 46, and is installable onto the attachment shaft portion 37. That is, the lever member 33 is installed on the attachment shaft portion 37 with any one set of the three rear grooves 38*a* and front grooves 38*b* aligned in a row in the front-rear direction. Then, the lever member 33 has the multilevel portion 42, and the apex portion 43 of the lever portion 40 is configured to pass through the interspace of the pair of protrusion members 46, thereby making it possible to swing the lower part of the pair of protrusion members 46.

Figure 9A:
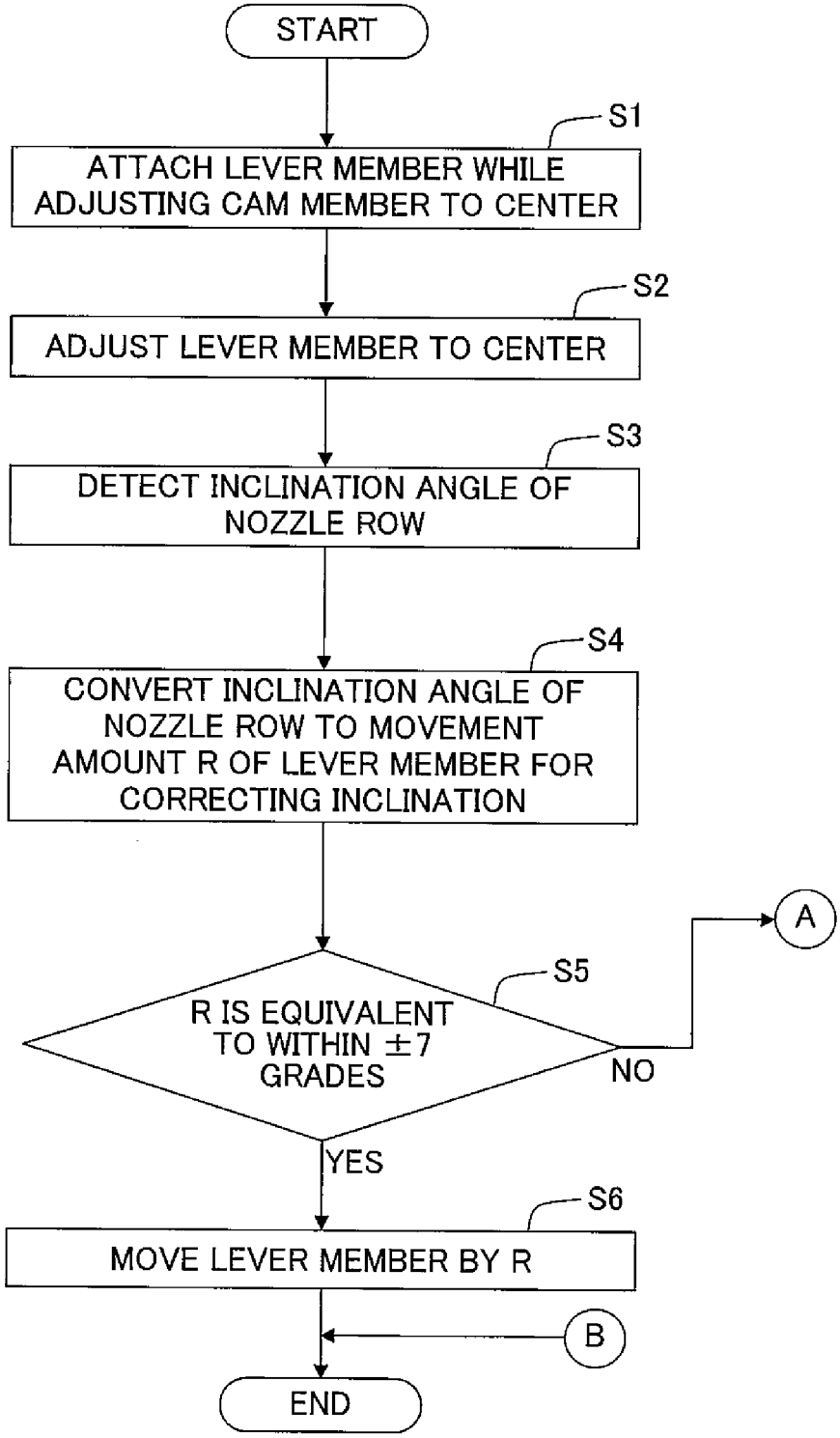
FIGS. 9A and 9B are a flowchart for explaining a process of adjusting the inclination of the carriage.
Figure 9B:
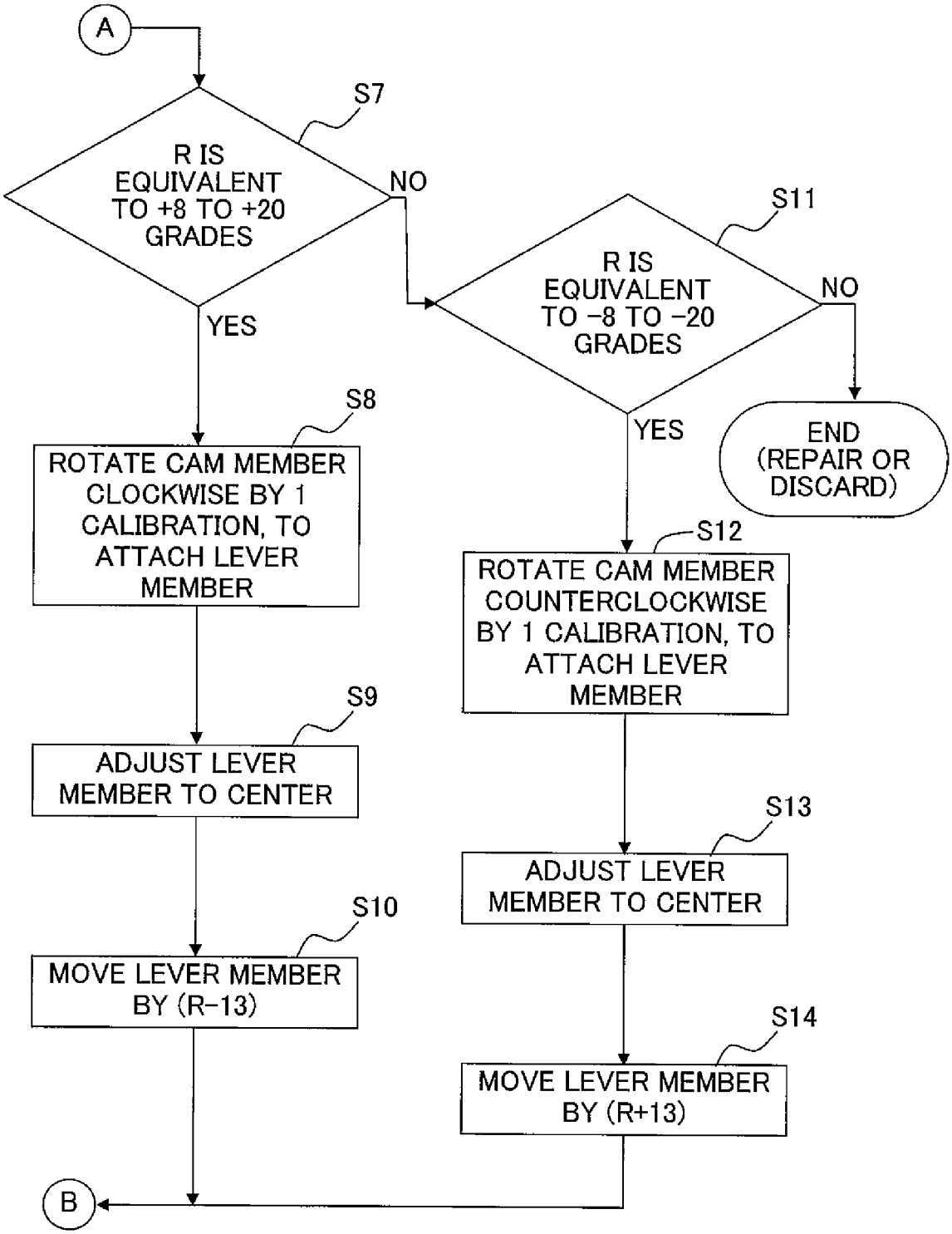

Next, referring to FIG. 9, explanations will be made with respect to a process of adjusting the inclination of the carriage 3 by the inclination adjustment mechanism 30. As shown in FIG. 9, first, when assembling the product, after placing the ink jet head 4 on the carriage 3, as the initial position, among the three rear grooves 38*a*, the middle rear groove 38*a* (the projection 36 of the direction indication portion 35) is turned to face the rear side, and the lever member 33 is attached (S1). Then, the lever member 33 is fitted in to the center of the display portion 47 (S2). Further, as described above, between the pair of protrusion members 46 protruding from the opposite surfaces of the pair of regulation walls 44 of the carriage 3, there is formed the interspace through which the lever portion 40 is passable. By attaching the lever member 33 through this interspace, it is possible to positionally fit the apex portion 43 of the lever portion 40 to the middle lock groove 45. Then, an inclination angle of the nozzle alignment direction is detected with respect to the transport direction based on the posture of the carriage 3 at that time (S3: an inclination detection process).

This detection method may as well be configured to detect the inclination angle of a line, for example, formed by the landing of ink with respect to the recording paper P by jetting the ink to form the straight line from the nozzles 6 constituting one nozzle column, on the recording paper P transported in the transport direction. Further, with the carriage 3, on which the ink jet head 4 is placed, being fixed on a fixture, the inclination angle of the nozzle alignment direction may as well be detected with respect to the transport direction from a relationship between the transport direction and a predetermined direction by detecting the inclination angle with respect to the predetermined direction of the nozzle alignment direction by directly measuring the nozzles 6 with a microscope and the like.

Then, the inclination angle of the nozzle column detected in the inclination detection process, is converted to a movement amount R of the lever member 33 for correcting this inclination angle (S4). If the movement amount R is equivalent to ±7 grades or less (S5: yes), then the lever member 33 is moved by the movement amount R as it is, so as to parallelize the nozzle alignment direction to a reference direction (S6).

Further, if the movement amount R is larger than ±7 grades (S5: No), and equivalent to +8 to +20 grades (S7: Yes), then the cam member 32 is rotated by one calibration in clockwise direction to attach the lever member 33 with an angular arrangement different from the case of the step S1 so that a rear groove 38*a* which is different from the case of the step S1 faces the rear side (S8). Then, the lever member 33 is positioned to the center (S9). Thereafter, the lever member 33 is moved by the movement amount (R−13) to parallelize the nozzle alignment direction to the reference direction (S10).

Further, if the movement amount R is not equivalent to +8 to +20 grades (S7: No) but equivalent to −8 to −20 grades (S11: Yes), then the cam member 32 is rotated by one calibration in counterclockwise direction to attach the lever member 33 with an angular arrangement different from the cases of the steps S1 and S8 so that a rear groove 38*a* which is different from the cases of the steps S1 and S8 faces the rear side (S12). Then, the lever member 33 is positioned to the center (S13). Thereafter, the lever member 33 is moved by the movement amount (R+13) to parallelize the nozzle alignment direction to the reference direction (S14). Then, the apex portion 43 of the lever portion 40 is locked with the lock groove 45 at a predetermined position to fix the inclination of the carriage 3 to the guide rail 8 and end the inclination adjustment of the carriage 3. Further, as in the step S7, it is also practicable to determine whether or not to refit the lever member 33 to the cam member 32 (to change the angular arrangement of the lever member 33 to the cam member 32), with the movement amount R not between +7 and +8 but between +6 and +7 or between +5 and +6. In the same manner, the determination in the step S11 may as well be made with the movement amount R not between −7 and −8 but between −6 and −7 or between −5 and −6. However, in order to reduce the workload by lowering the frequency of refitting the lever member 33 to the cam member 32, as in the step S7 (S11), it is preferable to determine whether or not to refit the lever member 33 to the cam member 32 with the movement amount R between +7 (−7) and +8 (−8).

Further, if the movement amount R is not equivalent to −8 to −20 grades, that is, if it is necessary for a greater adjustment than ±20 (S11: No), then the ink jet head 4 is determined to have some defective parts which should be replaced, repaired, or discarded. Further, the steps S5, S7 to S9, and S11 to S13 in the embodiment correspond to a first adjustment process in accordance with the present invention. Further, the steps S6, S10, and S14 in the embodiment correspond to a second adjustment process in accordance with the present invention. Further, the transport direction in the embodiment corresponds to a reference direction in accordance with the present invention.

Figure 10:
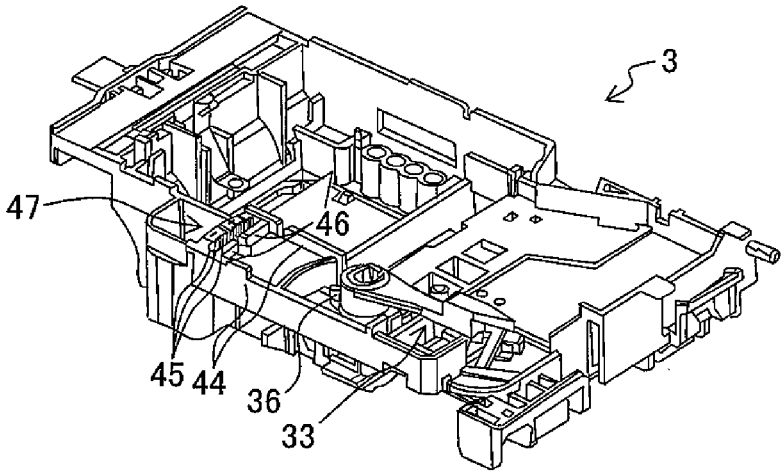
FIG. 10 is a perspective view of the vicinity of the carriage in a first adjustment process.
Figure 10:
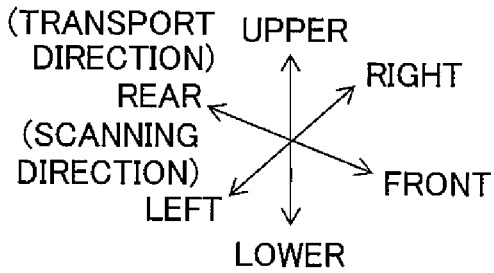

Here, when rotating the eccentric cam 34 inside the through hole 31*a* of the slide member 31 in the steps S8 and S12, because the eccentric cam 34 is pressed into the through hole 31*a* by applying an intense pressure, it is difficult for an operator to hold the cam member 32 by hand and rotate the same. Therefore, as shown in FIG. 10, the lever member 33 is attachable to the attachment shaft portion 37 even if the up-down direction is reversed. Further, by forming the three front grooves 38*b* point-symmetrical with the three rear grooves 38*a* in the attachment shaft portion 37, in addition to the three rear grooves 38*a*, it is possible to attach the lever member 33 to the attachment shaft portion 37 even if the front-rear direction is reversed.

Then, the lever member 33 is swung after the lever member 33 is attached to the attachment shaft portion 37 upside down and foreside back. By virtue of this, because the lever member 33 is no longer restrained from its swinging by the pair of regulation walls 44, it is possible to easily rotate the eccentric cam 34 such that any one of the three rear grooves 38*a* on the left or the right may face the rear side. At this time, because the middle rear groove 38*a* among the three rear grooves 38*a* faces the same direction as the projection 36, it is possible to prevent any misrecognition of the rear groove 38*a* and the front groove 38*b*. Further, the plurality of rear grooves 38*a* and the plurality of front grooves 38*b* in the embodiment correspond to a third engagement portion in accordance with the present invention. Further, the projections 41*a* and 41*b* in the embodiment correspond to a fourth engagement portion in accordance with the present invention. In this case, although in the embodiment, the third engagement portion doubles as the first engagement portion and fourth engagement portion doubles as the second engagement portion, they may as well be provided separately.

According to the ink jet printer 1 in the embodiment, by rotating the cam member 32, taking the rotation center to be the contact portion of the guide surface 15*a* of the guide wall 15 of the guide rail 8 with the slide surface 20*a* of the fixed slide member 20, by displacing the rotation shaft portion 23 of the carriage 3 with respect to the guide rail 8 in the rotation direction within the horizontal plane, the carriage 3 is rotated within the horizontal plane to adjust the inclination of the carriage 3 with respect to the guide rail 8. At this time, without directly rotating the cam member 32, with the lever member 33 installed on the cam member 32, the lever member 33 is swung to rotate the cam member 32.

According to this configuration, because the movement amount of the apical side of the lever portion 40 is large with respect to the small rotation angle of the cam member 32 when the lever member 33 is swung, it becomes easy to minutely adjust the inclination of the carriage 3. Therefore, by minutely setting the rotation angle of the cam member 32 (the swing angle of the lever member 33), it is possible to minutely adjust the inclination of the carriage 3.

Further, by switching the position of the rear groove 38*a* (the front groove 38*b*) engaged by the projection 41*a* (the projection 41*b*) of the lever member 33 with respect to the three rear grooves 38*a* (the front grooves 38*b*) of the cam member 32, it is possible to install the lever member 33 to the cam member 32 at a plurality of different angles. By virtue of this, it is possible to shift the range of adjusting the inclination of the carriage 3 by switching the rotation angle of the cam member 32 with the installed lever member 33 facing the rear side. Therefore, without widening the range of swinging the lever member 33, it is still possible to secure a wide range of adjusting the inclination of the carriage 3 and, meanwhile, miniaturize the inclination adjustment mechanism 30. Further, the rotation angle of the eccentric cam 34 corresponding to the range of adjusting the inclination of the carriage 3 in the embodiment, corresponds to the rotation angle possible for the cam member to take as the adjustment is finished in accordance with the present invention.

Further, if the number of the rear grooves 38*a* (front grooves 38*b*) is increased, then it is possible to secure an even wider range of adjusting the inclination of the carriage 3. Further, if the length of the lever member 33 is increased, then it is possible to adjust the inclination of the carriage 3 more minutely at a high resolution.

Then, according to the foregoing inclination adjustment of the carriage 3 by the inclination adjustment mechanism 30, first, in the first adjustment process, the inclination of the carriage 3 is adjusted greatly such that the inclination of the nozzle alignment direction with respect to the transport direction may come within the range to be adjustable by the swing of the lever member 33. Thereafter, in the second adjustment process, by swinging the lever member 33, and finely adjusting the inclination of the carriage 3, it is possible to parallelize the nozzle alignment direction to the transport direction. By virtue of this, without widening the range of swinging the lever member, it is possible to secure a wide range of adjusting the inclination of the carriage 3 and, meanwhile, miniaturize the inclination adjustment mechanism 30.

Next, explanations will be made with respect to modifications which have applied various changes to the present embodiment. Note that, however, explanations will be omitted as appropriate for components which are the same as or equivalent to those of the embodiment.

In the above embodiment, the angular range for the lever member 33 to be swingable between the pair of the regulation walls 44 is taken to be not smaller than the angle between two rear grooves 38*a* adjacent to each other in the circumferential direction of the attachment shaft portion 37 with the rotation shaft portion 23 as the center. However, the angular range may as well be smaller than that angle. In this case, although it is not possible to continuously secure a wide range in which the inclination of the carriage 3 is adjustable, when predicting beforehand a tendency of the inclination of the nozzle alignment direction with respect to the transport direction, etc., if it is made possible to adjust the inclination of the carriage 3 only within a necessary range, then it is not necessary to continuously secure a wide range for the inclination of the carriage 3 to be adjustable.

Further, in the above embodiment, although the eccentric cam 34 is truly circular, it is not limited to this but may as well be an elliptic eccentric cam.

Further, the number of the rear grooves 38*a* (the front grooves 38*b*) of the attachment shaft portion 37 for engagement with the projection 41*a* (the projection 41*b*) of the lever member 33 is not limited to three, but may as well be two or more than three. Further, the number of the lock grooves 45 for lock with the apex portion 43 of the lever member 33 is also not limited to 15 grades of ±7 grades plus the reference position, but an arbitrary number of lock grooves 45 may be formed for an arbitrary number of grades.

Further, only grooves of either the rear grooves 38*a* or the front grooves 38*b* may be formed in the attachment shaft portion 37. In this case, in the lever member 33, only the projection 41*a* may be formed to correspond to the rear grooves 38*a*, or only the projection 41*b* may be formed to correspond to the front grooves 38*b*.

Further, in the above embodiment, the cam surface 34*a* of the eccentric cam 34 is in direct contact with the contact surface 31*b* of the slide member 31. However, the present invention is not limited to this but may as well be configured such that another member or mechanism may stand between the slide member 31 and the end portion of the cam surface 34*a* of the eccentric cam 34 in the front-rear direction, and the slide member 31 may be moved in sliding by the cam surface 34*a* of the eccentric cam 34 via the above member or mechanism. Further, without providing the slide member 31, the cam surface 34*a* of the eccentric cam 34 may directly contact with the guide surface 15*a* of the guide wall 15.

Further, in the above embodiment, the projections 41*a* and 41*b* are formed on the swing shaft portion 39 of the lever member 33, and the rear grooves 38*a* (the front grooves 38*b*) are formed in the cam member 32 to be engageable with these projections 41*a* and 41*b* such that it is possible to selectively position the lever member 33 to any of a plurality of positions. However, the present invention is not limited to this configuration for positioning the lever member 33 to the cam member 32. For example, one groove may be formed in the portion of the lever member 33 with the projection 41*a* (the projection 41*b*) formed, while a plurality of projections may be formed in the portion of the cam member 32 with the rear grooves 38*a* (the front grooves 38*b*) formed. Further, the engagement is not limited to the projection with the groove but may as well be in any shape. For example, by applying pressure to press the taper surface 37*a* of the attachment shaft portion 37 into the through hole 39*a* of the swing shaft portion 39, a contact pressure occurs in a radial direction of the attachment shaft portion 37 between the inner circumferential surface of the through hole 39*a* and the taper surface 37*a*. Then, by the contact pressure in the radial direction of the attachment shaft portion 37, because a friction force occurs in the circumferential direction of the inner circumferential surface of the through hole 39*a* between the inner circumferential surface of the through hole 39*a* and the taper surface 37*a* of the attachment shaft portion 37, by this friction force, the lever member 33 and the cam member 32 may as well be rotated integrally.

Figure 11:
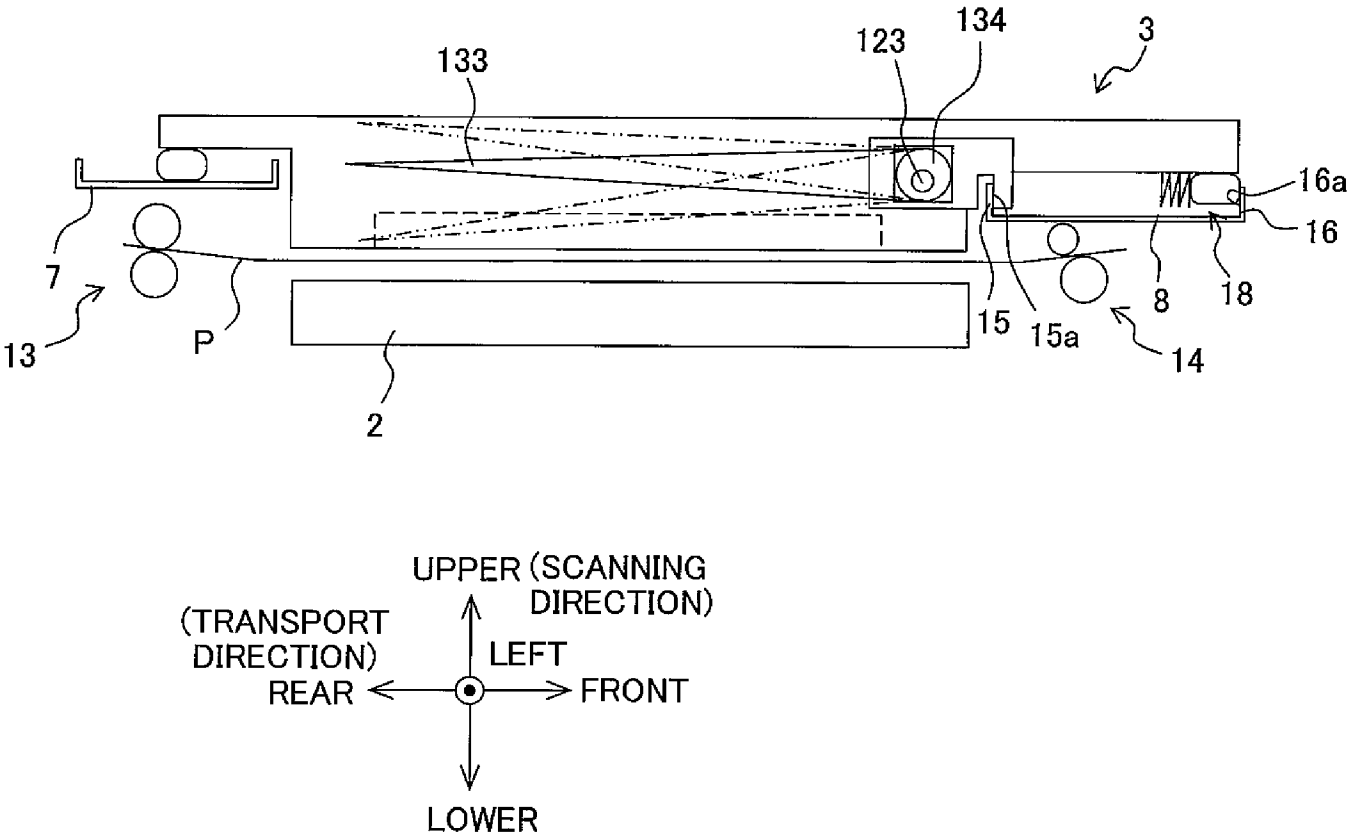
FIG. 11 is a side view of a carriage in accordance with a modification.

Further, in the above embodiment, the rotation shaft (the rotation shaft portion 23) of the eccentric cam 34 extends in the up-down direction. However, the rotation shaft is not limited to this but may as well extend in any other direction than the up-down direction as long as intersecting the swinging direction. For example, as shown in FIG. 11, the rotation shaft of an eccentric cam 134 (a rotation shaft portion 123 provided on the carriage 3) may extend in the left-right direction. Then, as shown by the broken lines in FIG. 11, it is preferable to restrict the swinging of a lever member 133 within the range between the upper end position and the lower end position of the carriage 3 in the vertical plane. According to such a configuration, the lever member 133 will not swing to the outer side than the carriage 3 in the up-down direction. Therefore, it is possible to make a thinner ink jet head 4. Further, it is possible to prevent the recording paper P from contact with the lever member 133 and the like projecting to be closer to the recording paper P than the ink jet surface 4*a*.

Further, the plurality of lock grooves 45 may as well not be provided. The lever member 33 can still maintain the angle without the lock grooves 45, because its rotation is fixed only by the press-in friction force due to the application of a intense pressure to press the eccentric cam 34 into the through hole 31*a*. By virtue of this, it is possible to raise the resolution in the adjustment.

Further, in the above embodiment, the nozzle alignment direction is along the transport direction, and the reference direction in accordance with the present invention is the transport direction. However, the nozzle alignment direction may as well be oblique to the transport direction and, in this case, the reference direction in accordance with the present invention is oblique to the transport direction.

Further, in the above description, although the present invention is applied to an ink jet printer of a serial type, it is also possible to apply the present invention to an ink jet printer having a plurality of ink jet heads of a line type. In a line-type ink jet printer, a plurality of nozzles form nozzle rows each of which is aligned in a direction perpendicular to the transport direction. Then, if the nozzle row direction is inclined to the direction perpendicular to the transport direction among the ink jet heads, then straight lines may deviate, or inks of different colors cannot be landed in the same position. Therefore, for the line-type ink jet printer, it is also necessary to adjust an inclination of the nozzle row direction for the plurality of ink jet heads. The direction perpendicular to the transport direction in this modification corresponds to the reference direction in accordance with the present teaching. In the embodiment, for the carriage 3 on which one ink jet head 4 is placed, one fixed slide member 20 and one movable slide member 21 are provided. However, in the case of a line-type ink jet printer, for each ink jet head, one fixed member and one movable member may be provided in an extension direction of the ink jet head to adjust the inclination of the nozzle column direction with respect to the reference direction. In this case, by displacing the movable member in the transport direction with the fixed member as the center, it is possible to adjust the inclination of the nozzle row direction with respect to the reference direction. Further, being not limited to one fixed member and one movable member, two movable members may be provided in the extension direction of the ink jet head, and these two movable members may be displaced in the transport direction. In this case, compared with the case of providing one fixed member and one movable member, it is possible to more precisely adjust the inclination of the nozzle row direction with respect to the reference direction.

Further, being not limited to an ink jet printer carrying out printing by jetting inks from nozzles, it is also possible to apply the present invention to any liquid jetting apparatus jetting liquids other than inks from nozzles.

What is claimed is:

1. A liquid jetting apparatus comprising:

a liquid jetting head which has a liquid jetting surface in which a plurality of nozzles are aligned along a predetermined nozzle alignment direction;

a head holder which holds the liquid jetting head and which is rotatable within a plane parallel to the liquid jetting surface;

a rotation regulation member which contacts with two contact portions of the head holder within the plane to regulate rotation of the head holder within the plane; and an inclination adjustment mechanism of the head holder, which has a cam member being rotatable about a rotation shaft provided in the head holder and being capable of displacing a first contact portion of the head holder, which is one of the two contact portions relative to the liquid jetting head, in a direction including a directional component perpendicular to a direction linking the first contact portion with a second contact portion of the head holder, which is the other of the two contact portions, within the plane, and which adjusts inclination of the head holder regulated by the rotation regulation member by rotating the cam member to rotate the head holder about the second contact portion, wherein the inclination adjustment mechanism includes a lever member which is attached to the cam member at a plurality of angular positions in a rotation direction of the cam member and which is rotatable integrally with the cam member in an attached state, wherein the head holder includes a carriage which holds the liquid jetting head and reciprocates in a first direction parallel to the liquid jetting surface, and wherein the rotation regulation member is a guide member which extends in the first direction, which has a guide surface not parallel to the liquid jetting surface, and which guides the carriage along the guide surface.

2. The liquid jetting apparatus according to claim 1, wherein the cam member has a plurality of first engagement portions;

the lever member has a second engagement portion engageable with one of the first engagement portions at the plurality of angular positions each of which is different in a first angle in the rotation direction of the cam member; and the lever member is attached to the cam member in such a state that one of the first engagement portions engages with the second engagement portion at any one angular position of the plurality of angular positions.

3. The liquid jetting apparatus according to claim 1, wherein the lever member is detachably attached to the cam member.

4. The liquid jetting apparatus according to claim 2, wherein the inclination adjustment mechanism further includes a fixation member provided in the head holder to restrain the lever member from being swingable beyond an angular range at each of the plurality of angular positions, the rotation shaft extends in a direction approximately perpendicular to a displacement direction of the first contact portion, and the angular range is within an angular range narrower than 180 degrees and smaller than a rotation angle of the cam member for adjusting the inclination of the carriage.

5. The liquid jetting apparatus according to claim 4, wherein the fixation member fixes an apex of the lever member at a plurality of positions each of which is different in a second angle smaller than the first angle.

6. The liquid jetting apparatus according to claim 5, wherein the rotation shaft extends in a direction perpendicular to the liquid jetting surface, and the plurality of positions at which the fixation member can fix the apex of the lever member are arranged such that the apex of the lever member is fixed within a width of the cam member in a first direction parallel to the liquid jetting surface.

7. The liquid jetting apparatus according to claim 5, wherein the first contact portion includes a slide member configured to be slidable with respect to the rotation regulation member in a first direction parallel to the liquid jetting surface, the rotation shaft extends in a direction perpendicular to the liquid jetting surface, and the plurality of positions at which the fixation member fixes the apex of the lever member are arranged such that the apex of the lever member is fixed within a width of one of the slide member and the cam member in the first direction.

8. The liquid jetting apparatus according to claim 5, wherein the rotation shaft extends in a first direction parallel to the liquid jetting surface, and the plurality of positions at which the fixation member fixes the apex of the lever member are arranged such that the apex of the lever member is fixed within a thickness of the liquid jetting head and the head holder in a direction perpendicular to the liquid jetting surface.

9. The liquid jetting apparatus according to claim 5, wherein the plurality of positions at which the fixation member can fix the apex of the lever member exist in a range not narrower than the first angle with the rotation shaft as the center.

10. The liquid jetting apparatus according to claim 5, wherein the fixation member has a plurality of lock portions locking the apex of the lever member to fix the lever member at each of the plurality of positions.

11. The liquid jetting apparatus according to claim 2, wherein the inclination adjustment mechanism further includes a pair of regulation members provided in the head holder and arranged at a predetermined interval, the lever member is accommodated between the pair of regulation members to be restrained from swinging beyond the pair of regulation members, the rotation shaft extends in a direction approximately perpendicular to a displacement direction of the first contact portion, and the angular range in which the lever member can swing between the pair of regulation members is within an angular range narrower than 180 degrees and narrower than a rotation angle of the cam member for adjusting the inclination of the carriage.

12. The liquid jetting apparatus according to claim 1, wherein the cam member has a first cylinder portion having a first taper surface coaxial with the rotation shaft, the lever member has a second cylinder portion having a second taper surface contactable with the first taper surface of the first cylinder portion, the first taper surface and the second taper surface are engaged with each other by a contact pressure, and the cam member and the lever member are configured to be integrally rotatable around the rotation shaft.

13. The liquid jetting apparatus according to claim 4, wherein the cam member has a third engagement portion, and the lever member has a fourth engagement portion engageable with the third engagement portion of the cam member in a state of being not restrained from swinging by the fixation member.

14. A method for adjusting inclination of a head holder of the liquid jetting apparatus comprising:

a transport mechanism configured to transport a recording paper in a transport direction;

a liquid jetting head which has a liquid jetting surface in which a plurality of nozzles are aligned along a predetermined nozzle alignment direction and which is configured to jet liquid onto the recording paper transported in the transport direction by the transport mechanism;

a head holder which holds the liquid jetting head and which is rotatable within a plane parallel to the liquid jetting surface, wherein the head holder includes a carriage which holds the liquid jetting head and reciprocates in a first direction parallel to the liquid jetting surface;

a rotation regulation member which contacts with two contact portions of the head holder within the plane to regulate rotation of the head holder within the plane, wherein the rotation regulation member is a guide member which extends in the first direction, which has a guide surface not parallel to the liquid jetting surface, and which guides the carriage along the guide surface; and an inclination adjustment mechanism of the head holder, which has a cam member being rotatable about a rotation shaft provided in the head holder and being capable of displacing a first contact portion of the head holder, which is one of the two contact portions relative to the liquid jetting head, in a direction including a directional component perpendicular to a direction linking the first contact portion with a second contact portion of the head holder, which is the other of the two contact portions, within the plane, and which adjusts inclination of the head holder regulated by the rotation regulation member by rotating the cam member to rotate the head holder about the second contact portion such that the nozzle alignment direction becomes parallel to a reference direction, wherein the inclination adjustment mechanism includes a lever member which is attached to the cam member at a plurality of angular positions in a rotation direction of the cam member and which is rotatable integrally with the cam member in an attached state, wherein the cam member has a plurality of first engagement portions, wherein the lever member has a second engagement portion engageable with one of the first engagement portions at the plurality of angular positions each of which is different in a first angle in the rotation direction of the cam member, and wherein the lever member is attached to the cam member in such a state that one of the first engagement portions engages with the second engagement portion at any one angular position of the plurality of angular positions, the method comprising:

an inclination detection process for detecting an inclination angle of the nozzle alignment direction with respect to the reference direction;

a first adjustment process for determining the one of the first engagement portions to be engaged with the second engagement portion of the lever member among the plurality of first engagement portions of the cam member according to the inclination angle of the nozzle alignment direction detected in the inclination detection process, and rotating the cam member to fit the one of the first engagement portions into a position installable with the lever member; and a second adjustment process for swinging the lever member by engaging the second engagement portion of the lever member with the one of the first engagement portions of the cam member fitted into the position in the first adjustment process such that the nozzle alignment direction becomes parallel to the reference direction.

15. The method for adjusting inclination of a head holder according to claim 14, wherein the inclination adjustment mechanism further includes a fixation member provided in the head holder to restrain the lever member from being swingable beyond an angular range at each of the angular positions, the rotation shaft extends in a direction approximately perpendicular to a displacement direction of the first contact portion, the angular range is within an angular range narrower than 180 degrees and smaller than a rotation angle of the cam member for adjusting the inclination of the carriage, the cam member has a third engagement portion, and the lever member has a fourth engagement portion engageable with the third engagement portion of the cam member in a state of being not restrained from swinging by the fixation member; and wherein in the first adjustment process, the one of the first engagement portions is fitted into the position installable with the lever member, by engaging the fourth engagement portion of the lever member with the third engagement portion of the cam member to rotate the cam member and swinging the lever member without being restrained by the fixation member to rotate the cam member.

* * * * *